US006211116B1

(12) United States Patent
Defieuw et al.

(10) Patent No.: US 6,211,116 B1
(45) Date of Patent: Apr. 3, 2001

(54) SUBSTANTIALLY LIGHT-INSENSITIVE BLACK AND WHITE THERMOGRAPHIC RECORDING MATERIAL WITH IMPROVED IMAGE TONE

(75) Inventors: Geert Defieuw, Bonheiden; Johan Loccufier, Zwijnaarde; Yvan Hoogmartens, Wilrijk; Ingrid Geuens, Emblem, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/323,859

(22) Filed: Jun. 1, 1999

Related U.S. Application Data

(60) Provisional application No. 60/096,561, filed on Aug. 14, 1998.

(30) Foreign Application Priority Data

Jun. 8, 1998 (EP) ..... 98201964

(51) Int. Cl.[7] ..... B41M 5/28
(52) U.S. Cl. ..... 503/212; 503/202
(58) Field of Search ..... 503/202, 212

(56) References Cited

U.S. PATENT DOCUMENTS 5,891,616 * 4/1999 Gilliams et al. ..... 430/617

FOREIGN PATENT DOCUMENTS 2721828 12/1977 (DE) .
730196 9/1996 (EP) .
903625 3/1999 (EP) .

* cited by examiner

*Primary Examiner*—Bruce H. Hess
(74) *Attorney, Agent, or Firm*—Baker Botts L.L.P.

(57) ABSTRACT

A substantially light-insensitive black and white thermographic recording material having a support and a thermosensitive element containing a substantially light-insensitive organic silver salt, an organic reducing agent therefor in thermal working relationship therewith and a binder, characterized in that the thermosensitive element contains substantially light-insensitive mixed crystals of two or more silver salts of organic carboxylic acids with one or more carboxylic acid groups; and a recording process therewith.

12 Claims, No Drawings

SUBSTANTIALLY LIGHT-INSENSITIVE BLACK AND WHITE THERMOGRAPHIC RECORDING MATERIAL WITH IMPROVED IMAGE TONE

The application claims the benefit of U.S. Provisional Application No. 60/096,561 filed Aug. 14, 1998.

FIELD OF THE INVENTION

The present invention relates to thermographic recording materials whose prints have improved image tone.

BACKGROUND OF THE INVENTION

Thermal imaging or thermography is a recording process wherein images are generated by the use of thermal energy. In direct thermal thermography a visible image pattern is formed by image-wise heating of a recording material containing matter that by chemical or physical process changes colour or optical density. Such recording materials become photothermographic upon incorporating a photosensitive agent which after exposure to UV, visible or IR light is capable of catalyzing or participating in a thermographic process bringing about changes in colour or optical density.

Research Disclosure number 17029, published in June 1978, gives a survey of different methods of preparing organic heavy metal salts in section II. The invention examples of U.S. Pat. No. 5,380,635 and U.S. Pat. No. 5,434,043 describe the production of organic silver salts using fatty acids of the type HUMKO Type 9718 & Type 9022 from WITCO Co., which contain according to the manufacturer's catalogue a mixture of different fatty acids, in connection with their use in photothermographic recording materials. DE-OS 27 21 828 discloses a thermally developable light-sensitive material, consisting of a support, which contains thereon or in one or more layers at least (a) an organic silver salt, (b) a photocatalyst and (c) a reducing agent, wherein the organic silver salt (a) contains at least a silver salt with an uneven number of 21 or more carbon atoms; and examples with mixtures of two and three organic silver salts of monocarboxylic acids precipitated together, but all with 20 are more carbon atoms.

U.S. Pat. No. 5,677,121 discloses a heat-developable silver halide infrared ray-sensitive material comprising a support having on one side of the support an emulsion layer containing a binder, a nonsensitive silver salt, a reducing agent for silver ion and silver halide grains spectrally sensitized at a wavelength within the region of from 750 to 1400 nm, wherein the nonsensitive silver salt comprises a mixture of silver salts of at least three organic carboxylic acids, one of the acids is behenic acid, and the content of the behenic acid in the acids is from not less than 35 to less than 90 mol %.

However, technology from photothermographic materials on the basis of an organic silver salt, silver halide and a reducing agent is not readily extrapolatable to substantially light-insensitive thermographic recording materials on the basis of an organic silver salt and a reducing agent, since thermographic recording materials are subjected to image-wise heating whereas photothermographic materials are subjected to image-wise exposure and overall heating and much stronger reducing agents are used in thermographic recording materials than in photothermographic recording materials. Furthermore, thermographic recording materials are heated for much shorter times, typically 10 to 20 ms, during thermal development in thermographic printing than photothermographic recording materials, for which 10 s is an average heating time. Such shorter heating times make it difficult to obtain neutral image tones.

EP-A 730 196 discloses a heat-sensitive recording material suited for use in direct thermal imaging and having image-stabilization properties which material contains in a binder on a support (i) a substantially light-insensitive organic silver salt capable of thermally activated reduction to silver in thermal working relationship with (ii) at least one reducing agent capable of reducing the substantially light-insensitive organic silver salt when thermally activated, characterized in that the recording material contains in admixture with the reducing agent(s) at least one colourless photo-oxidizing substance that on exposure to ultraviolet radiation yields free radicals capable of inactivating the reducing agent(s) by oxidation, thereby rendering the reducing agent(s) incapable of reducing the organic silver salt to silver. Furthermore, in sub-claims the organic silver salt is silver palmitate, silver stearate or silver behenate or mixtures thereof. However, the efficacy of such physical mixtures is not exemplified. Physical mixtures in which each component forms a separate phase cannot be equated with mixed crystals in which the components together form a single phase.

Prior art substantially light-insensitive black and white thermographic recording materials exhibit an insufficiently neutral image colour. This is particularly important for thermographic recording materials for medical diagnostic applications for which image tone requirements are particularly severe, particularly at low optical densities. Prior art thermographic recording materials coated from solvent exhibit image tone closer to these requirements than those coated from aqueous media, although the latter are producible using much more environmentally friendly coating processes.

OBJECTS OF THE INVENTION

It is therefore an object of the present invention to provide substantially light-insensitive black and white thermographic recording materials coated from solvent media whose prints exhibit a more neutral image tone.

It is therefore another object of the present invention to provide substantially light-insensitive black and white thermographic recording materials coated from aqueous media whose prints exhibit a more neutral image tone.

Further objects and advantages of the invention will become apparent from the description hereinafter.

SUMMARY OF THE INVENTION

Surprisingly it has been found that substantially light-insensitive black and white thermographic recording materials coated from solvent or aqueous media and comprising mixed crystals of substantially light insensitive organic silver salts exhibit a more neutral image tone than physical mixtures thereof.

The above mentioned objects are realized by a substantially light-insensitive black and white thermographic recording material having a support and a thermosensitive element containing a substantially light-insensitive organic silver salt, an organic reducing agent therefor in thermal working relationship therewith and a binder, characterized in that the thermosensitive element contains substantially light-insensitive mixed crystals of two or more silver salts of organic carboxylic acids with one or more carboxylic acid groups.

A recording process is further provided according to the present invention comprising the steps of: (i) bringing an outermost layer of the above-mentioned thermographic recording material in proximity with a heat source; and (ii) applying heat from the heat source imagewise to the recording material while maintaining proximity to the heat source to produce an image; and (iii) removing the recording material from the heat source.

Preferred embodiments of the invention are disclosed in the dependent claims.

DETAILED DESCRIPTION OF THE INVENTION

In a preferred embodiment of the recording process, according to the present invention, the heat source is a thermal head with a thin film thermal head being particularly preferred.

SUBSTANTIALLY

By substantially light-insensitive is meant not intentionally light sensitive. By substantially solvent-free aqueous medium is meant that solvent, if present, is present in amounts below 10% by volume of the aqueous medium.

Substantially Light-Insensitive Mixed Crystals of Two or More Organic Silver Salts The substantially light-insensitive mixed crystals of two or more silver salts of organic carboxylic acids with one or more carboxylic acid groups of the present invention are produced by slow addition, preferably metered, of a soluble silver salt to a solution or dispersion of a mixture of acids, or their salts, whose silver salts are capable of forming mixed crystals.

Mixed crystals of the present invention have the X-ray diffraction pattern of the organic silver salt which is present in the greatest quantity, although the peaks may be slightly shifted compared with the X-ray diffraction spectrum of pure crystals of the organic silver salt present in the greatest quantity.

It is preferred that the silver salts of organic carboxylic acids with one or more carboxylic acid groups are present in the mixed crystals of the mixed crystals used in the thermographic recording material of the present invention in molar concentrations of at least 5 mole % and particularly preferably with molar concentrations of at least 8 mole %.

It is also preferred that at least one of the two or more organic silver salts in the mixed crystals used in the thermographic recording material of the present invention is a silver salt of an aliphatic monocarboxylic acid with at least 12 carbon atoms, e.g. silver laurate, silver palmitate, silver stearate, silver hydroxystearate, silver behenate, silver arichidate and silver salts of modified aliphatic carboxylic acids with thioether group as described e.g. in GB-P 1,111,492. Particularly preferred silver salts of aliphatic carboxylic acids are selected from the group consisting silver stearate, silver arichidate and silver behenate.

It is further preferred that the total molar concentration of silver salts of aliphatic monocarboxylic acids in the mixed crystals used in the thermographic recording materials of the present invention is at least 40 per cent and particularly preferably at least 51% per cent.

In a particular embodiment of the present invention, the mixed crystals consist of two or more silver salts of aliphatic monocarboxylic acids with at least 12 carbon atoms, with three or more silver salts of aliphatic monocarboxylic acids with at least 12 carbon atoms being preferred and mixed crystals consisting of a mixture of silver stearate, silver behenate and silver arichidate being particularly preferred. The mixed crystals consisting of two or more silver salts of aliphatic monocarboxylic acids with at least 12 carbon atoms may be used on their own or in admixture with one or more organic silver salt in the thermosensitive element.

In a further embodiment of the present invention, one of the two or more organic silver salts is a silver salt of an aliphatic dicarboxylic acid. Preferred aliphatic dicarboxylic acids are selected from the group consisting of silver adipate, silver pimelate, silver suberate, silver azealate, silver sebacate, silver nonane-dicarboxylate, silver decane-dicarboxylate and silver undecane-dicarboxylate. It is preferred that the molar concentration of the silver salt of an aliphatic dicarboxylic acid in the mixed crystals of two or more organic silver salts is at least 15 per cent. Furthermore it is preferred that the molar concentration of silver salt of an aliphatic dicarboxylic acid in the mixed crystals of two or more organic silver salts is less than 50 per cent. The mixed crystals of two or more organic carboxylic acid may be used on their own or in admixture with one or more organic silver salt in the thermosensitive element.

Any organic silver salt may be used in admixture with the mixed crystals of the present invention. Preferred organic silver salts are silver salts of aliphatic monocarboxylic acids, known as fatty acids, wherein the aliphatic carbon chain has preferably at least 12 C-atoms.

Substantially Light-Insensitive Organic Silver Salt Dispersions

Mixed crystals of two or more organic silver salts may be dispersed by standard dispersion techniques e.g. using ball mills, bead mills, microfluidizers, ultrasonic apparatuses, rotor stator mixers etc. have been found to be useful in this regard.

Thermosensitive Element

The thermosensitive element, according to the present invention, comprises substantially light-insensitive mixed crystals of two or more organic silver salts, an organic reducing agent therefor in thermal working relationship therewith and a binder. The element may comprise a layer system in which the ingredients may be dispersed in different layers, with the proviso that the two ingredients are in reactive association with one another i.e. during the thermal development process the reducing agent must be present in such a way that it is able to diffuse to the mixed crystal of two or more organic silver salts and any organic silver salt present so that reduction to silver can occur.

Reducing Agents

Suitable organic reducing agents for the reduction of mixed crystals of two or more organic silver salts are organic compounds containing at least one active hydrogen atom linked to O, N or C.

Catechol-type reducing agents, i.e. reducing agents containing at least one benzene nucleus with two hydroxy groups (—OH) in ortho-position, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-B 692 733 and EP-A 903 625.

Combinations of reducing agents may also be used that on heating become reactive partners in the reduction of the substantially light-insensitive organic silver salt containing mixed crystals of two or more organic silver salts. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in US-P 5,545,515 and U.S. Pat. No. 5,635,339; and 2-substituted malonodialdehyde compounds as disclosed in U.S. Pat. No. 5,654,130.

Film-Forming Binders of the Thermosensitive Element

The film-forming binder of the thermosensitive element containing mixed crystals of two or more organic silver salts may be all kinds of natural, modified natural or synthetic resins or mixtures of such resins, in which the mixed crystals of two or more organic silver salts can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders such as gelatin, modified gelatines such as phthaloyl gelatin, polysaccharides, such as starch, gum arabic and dextran and water-soluble cellulose derivatives. A preferred water-soluble binder for use in the thermographic recording materials of the present invention is gelatin.

Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according to the present invention are water-dispersible film-forming polymers with covalently bonded moieties with one or more acid groups. Water-dispersible binders with crosslinkable groups, e.g. epoxy groups, aceto-acetoxy groups and crosslinkable double bonds are also preferred. Particularly preferred water-dispersible binders for use in the thermographic recording materials of the present invention are polymer latexes.

Toning Agent

In order to obtain a neutral black image tone in the higher densities and neutral grey in the lower densities, the thermosensitive element preferably further contains a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB-P 1,439,478, U.S. Pat. No. 3,951,660 and U.S. Pat. No. 5,599,647.

Stabilisers and Antifoggants

In order to obtain improved shelf-life and reduced fogging, stabilizers and antifoggants may be incorporated into the thermographic recording materials of the present invention.

Polycarboxylic Acids and Anhydrides Thereof

According to the recording material of the present invention the thermosensitive element preferably further contains at least one polycarboxylic acid and/or anhydride thereof in a molar percentage of at least 10 with respect to all the organic silver salt(s) present and in thermal working relationship therewith, with a molar percentage of at least 15 with respect to all the organic silver salt(s) being particularly preferred. The polycarboxylic acid may be aliphatic (saturated as well as unsaturated aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILONE™ Öl MA (from BAYER AG, GERMANY), ultraviolet light absorbing compounds, white light reflecting and/or ultraviolet radiation reflecting pigments and/or optical brightening agents.

Support

The support for the thermosensitive element according to the present invention may be transparent, translucent or opaque, e.g. having a white light reflecting aspect and is preferably a thin flexible carrier made e.g. from polypropylene, polycarbonate or polyester, e.g. polyethylene terephthalate.

The support may be in sheet, ribbon or web form and subbed if need be to improve the adherence to the thereon coated thermosensitive element. The support may be made of an opacified resin composition. Should a transparent base be used, the base may be colourless or coloured, e.g. having a blue colour. One or more backing layers may be provided to control physical properties such as curl and static.

Outermost Layer

The outermost layer of the recording material may in different embodiments of the present invention be the outermost layer of the thermosensitive element, a protective layer applied to the thermosensitive element or a layer on the opposite side of the support to the thermosensitive element.

Protective Layer

According to a preferred embodiment of the recording material, according to the present invention, the thermosensitive element is provided with a protective layer to avoid local deformation of the thermosensitive element and to improve resistance against abrasion.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer.

A protective layer according to the present invention may comprise in addition a thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative.

Crosslinking Agents For Outermost Layer

The outermost layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethyl-orthosilicate and tetraethylorthosilicate being preferred.

Matting Agents for Outermost Layer

The outermost layer of the recording material according to the present invention may comprise a matting agent. Suitable matting agents are described in WO 94/11198 and include e.g. talc particles and optionally protrude from the outermost layer.

Lubricants For Outermost Layer

Solid or liquid lubricants or combinations thereof are suitable for improving the slip characteristics of the thermographic recording materials according to the present invention. Preferred solid lubricants are thermomeltable particles such as those described in WO 94/11199.

Antihalation Dyes

In addition to the ingredients, the thermographic recording materials used in the present invention may also contain antihalation or acutance dyes which absorb infra-red light, for absorption by a dye which converts the absorbed infra-red light into heat, which has passed through the thermosensitive element thereby preventing its reflection. Such dyes may be incorporated into the thermosensitive element or in any other layer of the recording material of the present invention.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, with a thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. Such thermal printing heads may be used in contact or close proximity with the recording material. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. The image-wise heating can be carried out such that heating elements not required to produce an image pixel generate an amount of heat ($H_e$) in accordance with the following formula: $0.5\ H_D<H_e<H_D$ wherein $H_D$ represents the minimum amount of heat required to cause visible image formation in the recording material.

EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of transparencies and reflection type prints. Application of the present invention is envisaged in the fields of both graphics images requiring high contrast images with a very steep dependence of print density upon applied dot energy and continuous tone images requiring a weaker dependence of print density upon applied dot energy, such as required in the medical diagnostic field. In the hard copy field thermographic recording materials on a white opaque base are used, whereas in the medical diagnostic field black-imaged transparencies are widely used in inspection techniques operating with a light box.

The invention is illustrated hereinafter by way of invention examples and comparative examples. The percentages and ratios given in these examples are by weight unless otherwise indicated. The ingredients used in the invention and comparative examples, other than those mentioned above, are:

the aliphatic carboxylic acids:
- HAr=arachidic acid;
- HB=behenic acid;
- HPa=palmitic acid
- HSt=stearic acid;
- HAd=adipic acid;
- HSeb=sebacic acid;
- HSuc=succinic acid;

the silver salts of aliphatic carboxylic acids:
- AgAr=silver arachidate
- AgB=silver behenate;
- AgSt=silver stearate;
- AgPa=silver palmitate
- AgAd=silver adipate;
- AgSeb=silver sebacate;
- AgSuc=silver succinate;

the binders:
- B79=BUTVART™ B79, a polyvinyl butyral from MONSANTO;
- K7598=type 7598, a calcium-free gelatin from AGFA-GEVAERT GELATINEFABRIEK vorm. KOEPFF & SÖHNE;
- K17881=type 17881, a calcium-free gelatin from AGFA-GEVAERT GELATINEFABRIEK vorm. KOEPFF & SÖHNE;

the reducing agent:
- R0=ethyl 3,4-dihydroxybenzoate;

the toning agents:
- T01=7-(ethylcarbonato)-benzo[e][1,3]oxazine-2,4-dione;
- T02=benzo[e][1,3]oxazine-2,4-dione; and the silicone oil:
- BAYSILON™ MA, a polydimethylsiloxane from BAYER;

the surfactants:
- Surfactant Nr. 1=MARLON™ A-365, a 65% concentrate of a sodium alkyl-phenylsulfonate from HULS;

PREPARATION OF ORGANIC SILVER SALT TYPES I TO XIII

The behenic acid and the second acid, where appropriate, (together 0.8 mol of carboxylic acid)(see table 1 for quantity) was added to ca. 800 mL of 2-butanone in a 5 L vessel and the dispersion heated with stirring at 350 rpm to 70° C. giving a clear solution. Ca. 1.1 L of 0.75M aqueous sodium hydroxide was added slowly until a pH of ca. 9.9 was attained then after 5 minutes further stirring ca. 1 L of 0.8M aqueous silver nitrate was added at a constant rate of ca. 260 mL/h until a UAg (defined as the potential difference between a silver electrode of ≧99.99% purity in the aqueous liquid and a reference electrode consisting of a Ag/AgCl-electrode in 3M KCl solution at room temperature connected with the aqueous liquid via a salt bridge consisting of a 10% $KNO_3$ salt solution) of 315 mV was attained, thereby producing a ca. 12% dispersion of organic silver salt. The organic silver salt was then filtered off and washed four times with deionized water with 2% of 2-propanol, after which it was dried for 72 hours at 45° C.

TABLE 1

| Organic silver salt type | quantity of HB mole | quantity of other acid type | quantity of other acid mol | quantity of 2-butanone [mL] | volume of 0.75M NaOH added [mL] | 0.8M $AgNO_3$ volume added [mL] | 0.8M $AgNO_3$ addition time [min] |
|---|---|---|---|---|---|---|---|
| I | 0.455 | HSt/HAr | 0.09/0.455 | 800 | 1096 | 1000 | 240 |
| II | 0.455 | HSt/HAr | 0.09/0.455 | 800 | 1096 | 1000 | 240 |
| III | 0.75 | HAd | 0.05 | 800 | 1158# | 945 | 229 |
| IV | 0.402 | HAd | 0.198 | 773 | 1087# | 935 | 245 |
| V | 0.75 | HSeb | 0.05 | 800 | 1156# | 950 | 254 |
| VI | 0.402 | HSeb | 0.198 | 773 | 1083 | 875 | 219 |
| VII | 0.402 | HSuc | 0.198 | 773 | 1085 | 865 | 237 |
| VIII | 0.675 | HSt | 0.075 | 750 | 1015 | 938 | 238 |
| IX | 0.525 | HSt | 0.225 | 750 | 1019 | 938 | 255 |
| X | 0.375 | HSt | 0.375 | 750 | 1016 | 938 | 242 |
| XI | 0.450 | HSt/HPa | 0.15/0.15 | 750 | 1012 | 939 | 245 |
| XII | 0.80 | — | — | 800 | 1096 | 1000 | 240 |
| XIII | — | HSt | 0.75 | 750 | 992 | 926 | 66 |

#0.73M NaOH

X-ray diffraction spectra were then run on the dried organic silver salts of types I to VII and X to XII with an X-ray diffractometer using a CuKa X-ray source at a current of 30 mA and an energy of 40 kV in the Bragg angle 2Θ range 1.5 to 550 with a step-size of 0.050 and a step-time of 1 s. The XRD-spectra obtained all corresponded to the reference spectrum of the Joint Committee on Powder Diffraction Standards (JCPDS) Powder Diffraction File for AgB: 4-48, published by the International Centre for Diffraction Data, 12 Campus Boulevard, Newtown Square, Pa. 19073-3273 U.S.A. Qualifying remarks for the different organic silver salt types are given in table 2 below. These XRD-spectra clearly demonstrate the presence of mixed crystals in the case of organic silver salt types I to VII and X to XII.

TABLE 2

| Organic silver salt type | Composition AgB mol % | 2nd silver salt type | 2nd silver salt mol % | XRD-spectra in comparison with the reference spectrum for AgB (JCPDS# 4–48) |
|---|---|---|---|---|
| I | 45.5 | AgSt/AgAr | 9/45.5 | AgB-peaks shifted to slightly larger angles, no extra peaks |
| II | 45.5 | AgSt/AgAr | 9/45.5 | AgB-peaks shifted to slightly larger angles, no extra peaks |
| III | 93.34 | AgAd | 6.66 | AgB-peaks shifted to slightly larger angles, no extra peaks |
| IV | 67 | AgAd | 33 | as for type III except AgB-peaks more strongly shifted, extra signals at 2θ = 8.3° & 29.03 |
| V | 93.34 | AgSeb | 6.66 | AgB-peaks more strongly shifted to larger angles than for type III, no extra peaks |
| VI | 67 | AgSeb | 33 | as for type IV except for weak extra peaks at 2θ = 5.7° & 11.3° |
| VII | 67 | AgSuc | 33 | AgB-peaks shifted to slightly larger angles, extra peaks at 2θ = 26.4° (very weak), 29.37°, 30.22°, 39.15° |
| VIII | 90 | AgSt | 10 | no XRD spectrum run |
| IX | 70 | AgSt | 30 | no XRD spectrum run |
| X | 50 | AgSt | 50 | in addition to AgB, a second phase with the same crystal structure was present shifted to larger angles, no AgSt phase was identifiable |
| XI | 60 | AgSt/AgPa | 20/20 | AgB-peaks shifted to slightly smaller angles. no extra peaks |
| XII | 100 | — | — | extra signals at 2θ = 20.8° & 32.4° |
| XIII | — | AgSt | 100 | no XRD spectrum run |

#Joint Committee on Powder Diffraction Standards

INVENTION EXAMPLES 1 TO 10 AND COMPARATIVE EXAMPLE 1

Preparation of Organic Silver Salt Dispersions 10 g of organic silver salt (for composition see table 2) was mixed with 2.5 g of a 30% solution of B79 in 2-butanone and 737.5 g of 2-butanone for 72 hours in a ball mill. 30.83 g of a 30% solution of B79 in 2-butanone and 7.67 g of 2-butanone were then added to the resulting dispersion and the mixture ball milled for a further 60 minutes.

Preparation of Coating Dispersions 40 g of the organic silver salt dispersion was mixed with 29.86 g of a 30% solution of B79, 0.90 g of a 2-butanone dispersion containing 4.13% of B79, 14.01% of T01 and 25.86%, 0.40 g of BAYSILON™ MA and 0.323 g of adipic acid and 15 g of 2-butanone to a homogeneous dispersion. 1.844 g of R01, 0.288 g of tetrachloro-phthalic anhydride, 0.24 g of benzotriazole and 17.08 g of 2-butanone were then mixed separately and 9.59 g thereof was added to the homogenized organic silver salt dispersion prior to doctor blade coating with the blade adjusted to 170 μm onto a 175 μm thick subbed polyethylene terephthalate support. The resulting layers were dried for 1 hour at 50° C. to produce the thermosensitive elements of the thermographic recording materials of INVENTION EXAMPLES 1 to 10 and COMPARATIVE EXAMPLE 1 produced with type I to VII and IX to XI mixed crystals of organic silver salts and the silver behenate reference, organic silver salt type XII, respectively. After drying the thermographic recording materials of INVENTION EXAMPLES 1 to 7 and COMPARATIVE EXAMPLE 1 were subjected to 7 days conditioning at 45° C. and 70% relative humidity to produce "fresh materials" for printing.

Thermographic Printing

During the thermographic printing of the thermographic recording materials of INVENTION EXAMPLES 1 to 10 and COMPARATIVE EXAMPLE 1, the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic recording materials of INVENTION EXAMPLES 1 to 10 and COMPARATIVE EXAMPLE 1.

The maximum density, $D_{max}$, of the prints given in table 3 were measured through a visible filter with a MACBETH™ TR924 densitometer in the grey scale step corresponding to data levels of 64 and 0 respectively and the $D_{max}$-values are given in table 3 for INVENTION EXAMPLE 1 to 10 and COMPARATIVE EXAMPLE 1 together with the change in $D_{max}$-values upon printing a fresh material subjected to 7 days conditioning at 45° C. and 70% relative humidity (RH) compared with printing a fresh material also measured through a visible filer.

Image Evaluation

The image tone of fresh prints made with the thermographic recording materials of INVENTION EXAMPLES 1 to 10 and COMPARATIVE EXAMPLE 1 were assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The a* and b* CIELAB-values of fresh prints of the thermographic recording materials of INVENTION EXAMPLES 1 to 10 and COMPARATIVE EXAMPLE 1 at optical densities, D, of 0.5 and 1.0 are summarized in table 3.

TABLE 3

| | Organic silver salt type | Ag coverage [g/m²] | fresh material $D_{max}$ visible | $\Delta D_{max}$ visible for printing after 7d at 45° C./70% RH | CIELAB at D = 0.5 a* | CIELAB at D = 0.5 b* | CIELAB at D = 1.0 a* | CIELAB at D = 1.0 b* |
|---|---|---|---|---|---|---|---|---|
| Invention example number | | | | | | | | |
| 1 | I | 1.085 | 3.33 | −0.33 | −1.8 | 2.3 | −2 | 0.8 |
| 2 | II | 1.085 | 3.75 | +0.10 | −1.9 | 3.1 | −2 | 2 |
| 3 | III | 1.124 | 3.31 | −0.06 | −2.1 | 4.4 | −2.3 | 3.2 |
| 4 | IV | 1.480 | 1.78 | +0.02 | −0.9 | 4 | −1.5 | 1.8 |
| 5 | V | 1.118 | 3.70 | −0.10 | −2.2 | 4.7 | −2.5 | 3.6 |
| 6 | VI | 1.416 | 3.00 | −0.25 | −0.5 | 2.1 | −0.3 | 1.6 |
| 7 | VII | 1.511 | 2.21 | −0.01 | −0.6 | 5.4 | −0.6 | 2.7 |
| 8 | IX | — | — | — | −2.3 | 3.1 | −2.6 | 2.4 |
| 9 | X | — | — | — | −2.6 | 2.4 | −2.6 | 1.4 |
| 10 | XI | — | — | — | −2.4 | 2.4 | −2.5 | 1.9 |
| Comparative example nr | | | | | | | | |
| 1 | XII | 1.041 | 3.52 | +0.08 | −2 | 4.5 | −2.4 | 4 |

In terms of the visual perception of an image as a whole, the image tone of elements of the image with a density of 1.0 have a stronger effect than the image tone of elements with lower or higher optical. Furthermore, the image tone generally becomes more neutral as the density increases. The CIELAB co-ordinates for an optical density of 1.0 are therefore critical in assessing the perceived image tone of an image.

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming more yellow as b* becomes more positive.

In table 2, at least one of the CIELAB-values corresponding to an optical density of 1.0 for prints with the thermographic recording materials of INVENTION EXAMPLES 1 to 10 is lower than the corresponding value for the reference thermographic recording material of COMPARATIVE EXAMPLE 1. Prints with the thermographic recording materials of INVENTION EXAMPLES 1 and 2 with mixed crystals of organic silver salts prepared with HYSTREN™ 9022 from WITCO exhibit good tone neutrality as did the prints made with mixed crystals of organic silver salts of types IV and VI consisting of 67 mol % of silver behenate and 33 mol % of silver adipate and silver sebacate of INVENTION EXAMPLES 4 and 6 respectively.

INVENTION EXAMPLES 11 TO 14 AND COMPARATIVE EXAMPLE 2

Preparation of Organic Silver Salt dispersions 100 g of the respective organic silver salt was added to a mixture of 100 g of 10% solution of Surfactant Nr. 1 and 300 g of deionized water and the mixture stirred for 30 minutes with an ULTRA TURRAX stirrer. The resulting dispersions were then passed through a Type M110F high pressure homogenizer from MICROFLUIDICS™ Corporation at a pressure of 350 bar to obtain a finely divided aqueous dispersion of the organic silver salt. The final concentration of the different organic silver salts in the resulting dispersions is given in table 4.

Preparation of Coating Dispersions 0.310 g of boric acid was mixed with 12.287 g of deionized water and 3.450 g of K17881 and the K17881 was allowed to swell for 30 minutes before heating the swollen gelatin up to 36° C. The following ingredients were then added with stirring: 4.865 g of an aqueous dispersion of 6.44% of K7598 and 18.88% of phthalazinone followed by 10 minutes stirring, then 2 g of the organic silver salt dispersion (for type see table 4) and deionized water (for quantity see table 4) followed by 10 minutes stirring, then the rest of the organic silver salt dispersion (for total quantity, type and concentration of the organic silver salt see table 4), then 1 g of deionized water at a temperature of 50° C. and 1 g of R01 dissolved in 2 g of ethanol, then 1 g of an aqueous solution containing 19.2% of formaldehyde and 6.75% of methanol and finally 2 g of deionized water. The pH of the dispersion was adjusted to 5.3 just before coating.

TABLE 4

| | organic silver salt type | Organic silver salt dispersion conc. [%] | Organic silver salt dispersion quantity [g] | deionized water added [g] |
|---|---|---|---|---|
| Invention example number | | | | |
| 11 | IV | 19.40 | 23.730 | 8.358 |
| 12 | IV | 19.40 | 23.730 | 14.020 |
| 13 | VII | 19.14 | 23.526 | 8.562 |
| 14 | VII | 19.14 | 23.526 | 13.742 |
| Comparative | | | | |

TABLE 4-continued

| | organic silver | Organic silver salt dispersion | | deionized water added |
|---|---|---|---|---|
| | salt type | conc. [%] | quantity [g] | [g] |
| example nr | | | | |
| 2 | XII | 15.96 | 27.680 | 4.408 |

The resulting organic silver salt dispersions were then doctor blade-coated onto a 175 μm thick subbed polyethylene terephthalate support to produce after drying for 10 minutes at 50° C. the coating weights of silver given in table 5.

Thermographic Evaluation

Thermographic printing of the thermographic recording materials of INVENTION EXAMPLES 11 to 14 and COMPARATIVE EXAMPLE 2 was carried out as described for the thermographic recording materials of INVENTION EXAMPLES 1 to 10 and COMPARATIVE EXAMPLE 1. The maximum densities, $D_{max}$, and minimum densities, $D_{min}$, of the prints produced with the thermographic recording materials of INVENTION EXAMPLES 11 to 14 and COMPARATIVE EXAMPLE 2 measured through a blue filter with a MACBETH™ TR924 densitometer in the grey scale step corresponding to data levels of 64 and 0 respectively are given in table 5.

Image Tone Evaluation

Image tone evaluation was carried out as described above for INVENTION EXAMPLES 1 to 10 and COMPARATIVE EXAMPLE 1. The a* and b* CIELAB-values of fresh prints of the thermographic recording materials of INVENTION EXAMPLES 11 to 14 and COMPARATIVE EXAMPLE 2 at optical densities, D, of 0.5 and 1.0 are summarized in table 5.

TABLE 5

| | Ag coverage | organic silver | fresh material $D_{max}$ | $D_{min}$ | CIELAB at D = 0.5 | | CIELAB at D = 1.0 | |
|---|---|---|---|---|---|---|---|---|
| | [g/m²] | salt type | blue | blue | a* | b* | a* | b* |
| Invention example number | | | | | | | | |
| 11 | 1.537 | IV | 3.76 | 0.09 | −0.2 | +9.9 | +0.4 | >+10 |
| 12 | 1.226 | IV | 2.86 | 0.10 | −0.5 | +9.6 | +0.3 | +10.0 |
| 13 | 1.549 | VI | 4.11 | 0.11 | +1.3 | +7.4 | +1.9 | +9.1 |
| 14 | 1.200 | VI | 3.11 | 0.10 | +1.0 | +7.5 | +2.6 | +7.2 |
| Comparative example nr | | | | | | | | |
| 2 | 1.264 | XII | 4.19 | 0.09 | −1.7 | >10 | −1.4 | >10 |

Prints with the thermographic recording materials of INVENTION EXAMPLES 11 and 12 with mixed crystals of organic silver salts of types IV and INVENTION EXAMPLES 13 and 14 with mixed crystals of organic silver salts of type VI consisting of 67 mol % of silver behenate and 33 mol % of silver adipate and silver sebacate respectively exhibited a significant improvement in image tone neutrality compared with the thermographic recording material of COMPARATIVE EXAMPLE 2 with silver behenate.

INVENTION EXAMPLES 15 TO 17 & COMPARATIVE EXAMPLES 3 TO 5

Preparation of Coating Dispersions 40 g of an organic silver salt dispersion prepared as described for INVENTION EXAMPLES 1 to 10 & COMPARATIVE EXAMPLE 1 was mixed with 29.86 g of a 30% solution of B79, 0.90 g of a 2-butanone dispersion containing 4.13% of B79, 14.01% of T01 and 25.86%, 0.40 g of BAYSILON™ MA and 0.371 g of adipic acid and 15 g of 2-butanone to a homogeneous dispersion. 1.844 g of R01, 0.288 g of tetrachloro-phthalic anhydride, 0–24 g of benzotriazole and 17.08 g of 2-butanone were then mixed separately and 9.59 g thereof was added to the homogenized organic silver salt dispersion prior to doctor blade coating with the blade adjusted to 160 μm onto a 175 μm thick subbed polyethylene terephthalate blue-base support. The resulting layers were dried for 1 hour at 50° C. to produce the thermosensitive elements of the thermographic recording materials of INVENTION EXAMPLES 15 to 17 and COMPARATIVE EXAMPLES 3 to 5 produced with type VIII to X mixed crystals and mixtures of type XII and type XIII, respectively. The coating weights of silver are given in table 6. After drying all thermographic recording materials were subjected to 7 days conditioning at 45° C. and 70% relative humidity before printing.

Thermographic Evaluation

Thermographic printing of the thermographic recording materials of INVENTION EXAMPLES 15 to 17 and COMPARATIVE EXAMPLE was carried out as described for the thermographic recording materials of INVENTION EXAMPLES 1 to 10 and COMPARATIVE EXAMPLE 1. The maximum densities, $D_{max}$, and minimum densities, $D_{min}$, of the prints produced with the thermographic recording materials of INVENTION EXAMPLES 15 to 17 and COMPARATIVE EXAMPLE 3 to 5 measured through a blue filter with a MACBETH™ TR924 densitometer in the grey scale step corresponding to data levels of 64 and 0 respectively are given in table 5.

Image Tone Evaluation

Image tone evaluation was carried out as described above for INVENTION EXAMPLES 1 to 10 and COMPARATIVE EXAMPLE 1. The a* and b* CIELAB-values of prints produced with thermographic recording materials of INVENTION EXAMPLES 15 to 17 and COMPARATIVE EXAMPLES 3 to 5 on the fresh material (i.e. after 7 days conditioning at 45° C. and 70% relative humidity) at optical densities, D, of 1.0 and 2.0 are summarized in table 6.

In interpreting the neutrality of images on blue base it is necessary to refer to the a* and b* values of blue base as representing a neutral image, rather than a* and b* values of zero as was the case with polyethylene support without blue pigmentation. These reference values are:

a* of blue base used=−8.34 b* of blue base used=−15.71

Colour neutrality of images on blue base on the basis of CIELAB-values therefore corresponds to an a* value of −8.34 and a b* value of −15.71, with a more negative a*-value than −8.34 indicating a greenish image-tone becoming greener as a* becomes more negative, a value of a* more positive (i.e. less negative) than −8.34 indicating a reddish image-tone becoming redder as a* becomes more positive (i.e. less negative), a more negative b*-value than −15.71 indicating a bluish image-tone becoming bluer as b* becomes more negative and a more positive (i.e. less negative) b*-value than −15.71 indicating a yellowish image-tone becoming more yellow as b* becomes more positive.

TABLE 6

| | organic silver | fresh material | | CIELAB at D = 1.0 | | CIELAB at D = 2.0 | |
|---|---|---|---|---|---|---|---|
| | salt type(s) | $D_{max}$ blue | $D_{min}$ blue | a* | b* | a* | b* |
| Invention example nr | | | | | | | |
| 15 | VIII | 3.24 | 0.10 | −5.93 | −7.61 | −2.85 | −5.72 |
| 16 | IX | 2.97 | 0.10 | −4.94 | −7.90 | −2.25 | −6.10 |
| 17 | X | 2.79 | 0.10 | −5.42 | −7.68 | −2.13 | −6.17 |
| NEUTRAL IMAGE TONE WITH BLUE BASE | | | | −8.34 | −15.71 | −8.34 | −15.71 |
| Comparative example nr | | | | | | | |
| 3 | XII(96 mol %) XIII(10 mol %) | 2.91 | 0.10 | −4.90 | −7.78 | −1.93 | −6.36 |
| 4 | XII(70 mol %) XIII(30 mol %) | 2.95 | 0.10 | −5.05 | −7.76 | −1.94 | −6.33 |
| 5 | XII(50 mol %) XIII(50 mol %) | 3.21 | 0.10 | −5.09 | −7.47 | −1.68 | −5.76 |

The image tone perceived by an observer with images on a light box is more strongly influenced by the image tone of image densities at lower densities due to the lower blackness. Hence, the image tone for densities of 1.0 is more important than that for 2.0. When the CIELAB-values for the thermographic recording materials of INVENTION EXAMPLE 15, 16 and 17 with mixed crystals of silver behenate and silver stearate with 90, 70 and 50 mole % silver behenate respectively are compared with the thermographic recording materials of COMPARATIVE EXAMPLES 3, 4 and 5 with physical mixtures of silver behenate and silver stearate with 90, 70 and 50 mole % silver behenate respectively, the a*- and b*-values for the thermographic recording materials of INVENTION EXAMPLES 3, 4 and 5 are more neutral (i.e. closer to −8.34 and −15.71 respectively) than the respective COMPARATIVE EXAMPLES with the same molar concentration of silver behenate but as mixed crystals rather than physical mixtures, with the exception of the a*-value for the thermographic recording material of INVENTION EXAMPLE 16 which is comparable to that for COMPARATIVE EXAMPLE 4. It is therefore clear that the image tone of thermographic recording materials with mixed crystals of silver salts of organic carboxylic acids is surprisingly improved over that with thermographic recording materials with physical mixtures of the same silver salts of organic carboxylic acids in the same molar concentrations and therefore that the performance of mixed crystals of silver salts of organic carboxylic acids cannot be equated with that of physical mixtures thereof.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white thermographic recording material having a support and a thermosensitive element containing a substantially light-insensitive organic silver salt, an organic reducing agent therefor in thermal working relationship therewith and a binder, characterized in that said thermosensitive element contains substantially light-insensitive mixed crystals of two or more silver salts of organic carboxylic acids with one or more carboxylic acid groups.

2. Thermographic recording material according to claim 1, wherein at least one of said two or more organic silver salts is a silver salt of aliphatic monocarboxylic acids with at least 12 carbon atoms.

3. Thermographic recording material according to claim 2, wherein said mixed crystals consist of two or more silver salts of aliphatic monocarboxylic acids with at least 12 carbon atoms.

4. Thermographic recording material according to claim 3, wherein said mixed crystals consist of a mixture of silver stearate, silver behenate and silver arichidate.

5. Thermographic recording material according to claim 2, wherein said aliphatic monocarboxylic acid is selected from the group consisting of silver stearate, silver arichidate and silver behenate.

6. Thermographic recording material according to claim 1, wherein one of said two or more organic silver salts is a silver salt of an aliphatic dicarboxylic acid.

7. Thermographic recording material according to claim 6, wherein said aliphatic dicarboxylic acid is selected from the group consisting of silver adipate, silver pimelate, silver suberate, silver azealate, silver sebacate, silver nonane-dicarboxylate, silver decane-dicarboxylate and silver undecane-dicarboxylate.

8. Thermographic recording material according to any of the preceding claims, wherein said thermosensitive element further contains at least one polycarboxylic acid and/or anhydride thereof in a molar percentage of at least 10 with respect to all the organic silver salt(s) present.

9. Thermographic recording material according to any one of claims 1–7, wherein said thermosensitive element further contains an organic silver salt of an aliphatic monocarboxylic acid with at least 12 carbon atoms.

10. A recording process comprising the steps of (i) bringing an outermost layer of a thermographic recording material according to any one of claim 1 into proximity with a heat source and (ii) applying heat from said heat source imagewise to said thermographic recording material while maintaining proximity to said heat source to produce an image; and (iii) removing said thermographic recording material from said heat source.

11. Thermographic recording material according to any one of claims 1–7, wherein (i) said thermosensitive element further contains at least one polycarboxylic acid and/or anhydride thereof in a molar percentage of at least 10 with respect to all the organic silver salt(s) present and;

(ii) said thermosensitive element further contains an organic silver salt of an aliphatic monocarboxylic acid with at least 12 carbon atoms.

12. A recording process comprising the steps of: (i) bringing an outermost layer of a thermogaphic recording material according to claim 11 into proximity with a heat source; and (ii) applying heat from said heat source imagewise to said thermographic recording material while maintaining proximity 10 said heat source to produce an image; and (iii) removing said thermographic recording material from said heat source.

* * * * *